US010036513B2

(12) United States Patent
Patten et al.

(10) Patent No.: US 10,036,513 B2
(45) Date of Patent: Jul. 31, 2018

(54) GAS TRANSPORT COMPOSITE BARRIER

(71) Applicant: Red Leaf Resources, Inc., South Jordan, UT (US)

(72) Inventors: James W. Patten, South Jordan, UT (US); James W. Bunger, South Jordan, UT (US); Dan Seely, South Jordan, UT (US)

(73) Assignee: Red Leaf Resources, Inc., Salt Lake City, UT (US)

( * ) Notice: Subject to any disclaimer, the term of this patent is extended or adjusted under 35 U.S.C. 154(b) by 682 days.

(21) Appl. No.: 14/469,062

(22) Filed: Aug. 26, 2014

(65) Prior Publication Data

US 2015/0053269 A1 Feb. 26, 2015

Related U.S. Application Data

(60) Provisional application No. 61/870,089, filed on Aug. 26, 2013.

(51) Int. Cl.
*C10G 1/02* (2006.01)
*F17D 5/02* (2006.01)

(52) U.S. Cl.
CPC ..... *F17D 5/02* (2013.01); *C10G 1/02* (2013.01); *Y10T 137/0318* (2015.04); *Y10T 137/8593* (2015.04)

(58) Field of Classification Search
CPC ..... Y10T 137/0318; Y10T 137/8593; F17D 5/02
See application file for complete search history.

(56) References Cited

U.S. PATENT DOCUMENTS 3,447,235 A 6/1969 Rosvold et al.
3,447,286 A 6/1969 Dounoucos
(Continued)

FOREIGN PATENT DOCUMENTS

CN 101646749 A 2/2010
CN 102781548 A 11/2012
(Continued)

OTHER PUBLICATIONS

Civan, F. (2000) Reservoir Formation Damage, Gulf Professional Publishing, 752 pgs (Office action cites pp. 95-96).*
(Continued)

*Primary Examiner* — Brian A McCaig
(74) *Attorney, Agent, or Firm* — Thorpe North & Western, LLP

(57) ABSTRACT

A method of minimizing vapor transmission from a constructed permeability control infrastructure can comprise forming a heterogeneous hydrated matrix within the constructed permeability control infrastructure, the constructed permeability control infrastructure comprising a permeability control impoundment defining a substantially encapsulated volume. The heterogeneous hydrated matrix includes a particulate solid phase and a continuous liquid phase which is penetrable by a vapor having a permeation rate. The constructed permeability control infrastructure is operated to control the permeation rate by manipulating an operational parameter of the constructed permeability control infrastructure. Additionally, the vapor can be impeded during operating sufficient to contain the vapor within the constructed permeability control infrastructure.

18 Claims, 4 Drawing Sheets

(56) References Cited

U.S. PATENT DOCUMENTS

| | | | | |
|---|---|---|---|---|
| 3,705,838 | A | 12/1972 | Olton et al. | |
| 4,568,708 | A * | 2/1986 | Mason | C09K 8/50 166/293 |
| 4,613,544 | A | 9/1986 | Burleigh | |
| 4,908,129 | A | 3/1990 | Finsterwalder et al. | |
| 5,041,330 | A | 8/1991 | Heerten et al. | |
| 5,124,363 | A | 6/1992 | Stern | |
| 5,482,402 | A * | 1/1996 | Nelson | B09C 1/06 405/128.65 |
| 7,410,525 | B1 | 8/2008 | Liu et al. | |
| 7,862,705 | B2 | 1/2011 | Dana et al. | |
| 2005/0065262 | A1 | 3/2005 | Darlington et al. | |
| 2006/0002764 | A1 | 1/2006 | Legge et al. | |
| 2006/0009561 | A1 | 1/2006 | Kamoshita et al. | |
| 2006/0078753 | A1 | 4/2006 | Bomberg | |
| 2008/0017374 | A1 | 1/2008 | Surjaatmadja | |
| 2008/0190813 | A1 | 8/2008 | Dana et al. | |
| 2008/0190818 | A1* | 8/2008 | Dana | C10B 47/02 208/424 |
| 2009/0053542 | A1 | 2/2009 | Kuwata et al. | |
| 2009/0264321 | A1 | 10/2009 | Showalter et al. | |
| 2010/0012331 | A1 | 1/2010 | Larter et al. | |
| 2010/0151265 | A1 | 6/2010 | Okuzu et al. | |
| 2010/0200464 | A1 | 8/2010 | Dana et al. | |
| 2010/0200465 | A1 | 8/2010 | Dana et al. | |
| 2010/0200466 | A1 | 8/2010 | Dana et al. | |
| 2010/0200467 | A1 | 8/2010 | Dana et al. | |
| 2011/0094952 | A1 | 4/2011 | Dana et al. | |
| 2011/0138649 | A1 | 6/2011 | Patten | |
| 2011/0209882 | A1* | 9/2011 | Enis | E21B 43/006 166/402 |
| 2011/0286796 | A1 | 11/2011 | Patten | |
| 2011/0308801 | A1 | 12/2011 | Dana | |
| 2012/0141947 | A1 | 6/2012 | Dana | |
| 2012/0152540 | A1 | 6/2012 | Patil et al. | |
| 2012/0237757 | A1 | 9/2012 | Bismarck | |
| 2013/0333763 | A1 | 12/2013 | Keracik et al. | |

FOREIGN PATENT DOCUMENTS

| | | | |
|---|---|---|---|
| CN | 102889071 | A | 1/2013 |
| EP | 0936315 | A1 | 8/1999 |
| EP | 2379838 | B1 | 10/2011 |
| GB | 1439734 | A | 6/1976 |
| GB | 2081774 | A | 2/1982 |
| RU | 2002944 | C | 11/1993 |
| WO | WO 1992/02024 | A1 | 2/1992 |
| WO | WO 2012/085508 | A1 | 6/2012 |
| WO | WO 2015/017345 | A2 | 2/2015 |

OTHER PUBLICATIONS

Carrado et al.; Acid activation of bentonites and polymer-clay nanocomposites; Elements; Apr. 1, 2009; pp. 111-116; vol. 5, No. 2; The Mineralogical Association of Canada.

Doostmohammadi et al.; Swelling of Weak Rocks, Effective Parameters and Controlling Methods; ISRM International Symposium—5$^{th}$ Asian Rock Mechanics Symposium, Nov. 24-26, Tehran, Iran; Nov. 20008; 8 pages; International Society for Rock Mechanics and Iranian Society for Rock Mechanics.

PCT/US14/52705; filing date Aug. 26, 2014; Red Leaf Resources; International Search Report dated Nov. 26, 2014.

* cited by examiner

GAS TRANSPORT COMPOSITE BARRIER

RELATED APPLICATION(S)

This Application claims priority to U.S. Provisional Application No. 61/870,089, filed Aug. 26, 2013, which is incorporated herein by reference.

BACKGROUND

Processing of hydrocarbonaceous materials can often involve heating of feedstock materials to remove and/or produce hydrocarbons. A wide variety of processes can be used, however most processes inherently have particular challenges which limit productivity and/or large scale use. Hydrocarbonaceous materials such as tar sands and oil shale have been processed using both above-ground and in situ processing. Other hydrocarbonaceous materials such as coal have been processed using a wide array of technologies such as coal gasification and coal liquefaction. Recent developments in tar sands and oil shale processing technologies, in particular, continue to improve production efficiencies and reduce environmental impact. However, various challenges remain in terms of process stability, environmental impact and yields, among others.

SUMMARY

Systems for processing hydrocarbonaceous materials can include constructed impoundments which are designed to retain fluids during processing. Some impoundments can be formed of permeability control barriers which comprise a matrix of particulate materials. Transmission of vapors and liquids through a permeability control impoundment during the processing of hydrocarbonaceous materials can adversely affect the surrounding environment and result in loss of valuable product. As such, a method of minimizing vapor transmission from a constructed permeability control infrastructure can comprise forming a heterogeneous hydrated matrix within the constructed permeability control infrastructure. The constructed permeability control infrastructure comprises a permeability control impoundment defining a substantially encapsulated volume. The heterogeneous hydrated matrix is formed of a solid phase and a substantially continuous liquid phase which is penetrable via diffusion by a vapor having a permeation rate at given operating conditions. The constructed permeability control infrastructure can be operated to recover hydrocarbons. During operation the permeation rate can be controlled by manipulating an operational parameter of the constructed permeability control infrastructure, such that the vapor is impeded during operating sufficient to contain the vapor within the constructed permeability control infrastructure.

Additionally, a constructed permeability control infrastructure can comprise a permeability control impoundment defining a substantially encapsulated volume. Specifically, the impoundment can include a heterogeneous hydrated matrix which is penetrable by a vapor having a permeation rate which is a function of the vapor and matrix properties. A comminuted hydrocarbonaceous material within the encapsulated volume forms a permeable body of hydrocarbonaceous material. The heterogeneous hydrated matrix impedes the vapor sufficient to contain the vapor within the constructed permeability control infrastructure during operation.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
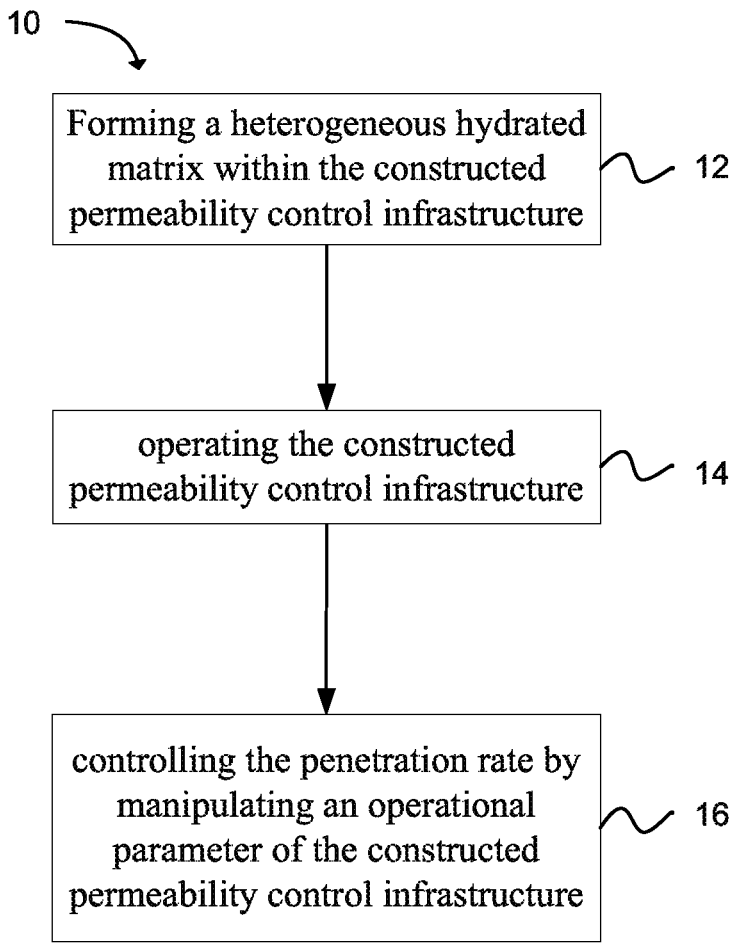
FIG. 1 is a flow chart of a method in accordance with one embodiment of the present invention.

It should be noted that the figures are merely exemplary of several embodiments of the present invention and no limitations on the scope of the present invention are intended thereby. Further, the figures are generally not drawn to scale, but are drafted for purposes of convenience and clarity in illustrating various aspects of the invention.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used. The singular forms "a," "an," and "the" include plural references unless the context clearly dictates otherwise. Thus, for example, reference to "a wall" includes reference to one or more of such structures, "a permeable body" includes reference to one or more of such materials, and "a heating step" refers to one or more of such steps.

As used herein, "constructed infrastructure" and "constructed permeability control infrastructure" refers to a structure which is substantially entirely man made, as opposed to freeze walls, sulfur walls, or other barriers which are formed by modification or filling pores of an existing geological formation. The constructed permeability control infrastructure can typically be substantially free of undisturbed geological formations, although the infrastructure can be formed adjacent or in direct contact with an undisturbed formation. The infrastructure can typically be formed using compacted earthen material or compacted particulate material. As such, infrastructure walls often do not have independent structural integrity apart from underlying earth foundation.

As used herein, "earthen material" refers to natural materials which are recovered from the earth with only mechanical modifications such as, but not limited to, swelling clay (e.g. bentonite clay, montmorillonite, kaolinite, illite, chlorite, vermiculite, etc.), gravel, rock, compacted fill, soil, and the like. Gravel, for example, may be combined with cement to form concrete. Frequently, clay amended soil can be combined with water to form a hydrated layer which acts as a fluid barrier. However, spent oil shale can also be used to form at least a portion of the earthen material used in infrastructure walls.

As used herein, "hydrocarbonaceous material" refers to hydrocarbon-containing material from which hydrocarbon products can be extracted or derived. For example, hydrocarbons may be extracted directly as a liquid, removed via solvent extraction, directly vaporized or otherwise liberated from the material. However, many hydrocarbonaceous materials contain hydrocarbons, kerogen and/or bitumen which is converted to a higher quality hydrocarbon product including oil and gas products through heating and pyrolysis. Hydro carbonaceous materials can include, but are not limited to, oil shale, tar sands, coal, lignite, bitumen, peat, biomass, and other organic rich rock.

As used herein, "impoundment" refers to a structure designed to hold or retain an accumulation of fluid and/or solid moveable materials. An impoundment generally derives at least a substantial portion of foundation and structural support from the ground. Thus, the control walls of the present invention do not always have independent strength or structural integrity apart from the ground and/or native formation against which they are formed. Further, an impoundment typically utilizes earthen materials and at least a portion of walls formed as berms of compacted earthen material.

As used herein, "permeable body" refers to a mass of comminuted hydrocarbonaceous material having a relatively high permeability which exceeds permeability of a solid undisturbed formation of the same composition. Permeable bodies suitable for use in the present invention can have greater than about 10% void space and typically have void space from about 20% to 40%, although other ranges may be suitable. Allowing for high permeability facilitates heating of the body through convection as a primary heat transfer mechanism while also substantially reducing costs associated with crushing to very small sizes, e.g. below about 2.5 to about 1 cm. Specific target void space can vary depending on the particular hydrocarbonaceous material.

As used herein, "heterogeneous hydrated matrix" refers to a solid particulate having a fluid absorbed or dispersed therein, where the fluid includes water.

As used herein, "mined" refers to a material which has been removed or disturbed from an original stratographic or geological location to a second and different location. Typically, mined material can be produced by rubbilizing, crushing, fracturing, displacing, or otherwise removing material from a native geologic formation.

As used herein, "substantially stationary" refers to nearly stationary positioning of materials with a degree of allowance for subsidence and/or settling as hydrocarbons are removed from the hydrocarbonaceous material. In contrast, any circulation and/or flow of hydrocarbonaceous material such as that found in fluidized beds or rotating retorts involves highly substantial movement and handling of hydrocarbonaceous material.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, and sub-ranges such as 10 to 50, 20 to 100, etc.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Controlling Vapor Transmission

Referring to FIG. 1, a method 10 of minimizing vapor transmission from a constructed permeability control infrastructure can include forming 12 a heterogeneous hydrated matrix within the constructed permeability control infrastructure. The constructed permeability control infrastructure comprises a permeability control impoundment defining a substantially encapsulated volume and the heterogeneous hydrated matrix is penetrable by a vapor having a permeation rate. The method further includes operating 14 the constructed permeability control infrastructure. Typically, operating can include heating a permeable body of hydrocarbonaceous material sufficient to produce and/or liberate hydrocarbons therefrom and can further include collecting and removing the hydrocarbons. Depending on the specific composition and structure of the permeable body, the conditions can vary in order to produce and/or liberate the hydrocarbons. The method can further include controlling 16 the permeation rate by manipulating an operational parameter of the constructed permeability control infrastructure. Generally, the methods of the present invention sufficiently impede permeation of the vapor through the hydrated matrix during operation such that the vapor is maintained within the constructed permeability control infrastructure.

The control of vapors during operation of the constructed permeability control infrastructure can be accomplished via manipulation of various operational and/or structural parameters. Composition of the heterogeneous hydrated matrix, composition of layers within the infrastructure, composition of the hydrocarbonaceous material, and size of the infrastructure are non-limiting examples of structural parameters. Similarly, temperatures, pressures, and process times are non-limiting examples of operational parameters. Generally, the present methods include the use of a heterogeneous hydrated matrix within at least a portion of the constructed permeability control infrastructure. Most often, the heterogeneous hydrated matrix can be configured as a substantially continuous layer within walls of the infrastructure. In one embodiment, the heterogeneous hydrated matrix can be within a wall of the constructed permeability control infrastructure. In one aspect, the heterogeneous hydrated matrix can be within each wall of the constructed permeability control infrastructure.

The heterogeneous hydrated matrix can be formed of a particulate solid phase and a substantially continuous liquid phase. Permeation of the heterogeneous hydrated matrix can thus be limited to diffusion through the liquid phase (e.g. typically an aqueous phase). In general, the lateral capillary dimension of the continuous liquid phase and the surface energy of the liquid-to-solid interface can be such that there is sufficient capillary tension (i.e. matric suction) to retain the liquid phase in the matrix in the presence of anticipated pressure difference across the heterogeneous hydrated matrix. The liquid phase capillary thickness and the liquid-to-solid surface energy can prevent pressure differences from draining or expelling liquid phase from the heterogeneous hydrated matrix. Generally, the heterogeneous hydrated matrix can be formed by hydrating an earthen material. The earthen material can include clay, bentonite clay, compacted fill, refractory cement, cement, bentonite amended soil, compacted earth, low grade shale, or combinations thereof. The earthen material can be comminuted to a size that, when hydrated, impedes the permeation rate. Such a size can be from about 0.5 μm to about 4 cm, or in one aspect, from 10 μm to 1 cm. The heterogeneous hydrated matrix can include a mixture of hydrating material and non-hydrating material. Hydrating material can include clay (e.g. bentonite clay or other swelling clays), and the like. Non-hydrating materials can include filler materials such as soil, rock, spent shale, sand, and the like. Proportions of hydrating material can be varied in order to achieve a target permeation time, i.e. one which is less than a designed process time. However, as a general guideline, hydrating material can comprise from about 4% to about 100% by volume of the heterogeneous hydrated matrix. In a specific embodiment, the matrix can include from about 5% to about 20% by volume of bentonite clay as the hydrating material. In another embodiment, the matrix can include at least 10% by volume of bentonite clay. Furthermore, the hydrating materials and non-hydrating materials can have substantially similar or different size distributions. In some cases, it can be desirable to formulate the heterogeneous hydrated matrix using a hydrated material size distribution which is smaller than a non-hydrating material size distribution.

Although the composition and configuration of the hydrated matrix can affect permeation rates, once the matrix is formed and in place controlling of the permeation rate can still be adjusted dynamically via operational conditions. As such, controlling of the permeation rate of the vapor can include maintaining hydration of the heterogeneous hydrated matrix and maintaining a continuous liquid phase. In one embodiment, maintaining hydration and a continuous liquid phase can be accomplished by controlling the operational parameters during operation. In another embodiment, maintaining hydration and a continuous liquid phase can include delivering of additional fluid to the hydrated matrix, before, during or after operation of the constructed permeability control infrastructure.

Regarding the operation parameters, controlling of the permeation rate of the vapor can include manipulating the temperatures, pressures, process times, etc. In one embodiment, controlling can include maintaining a target temperature within the permeability control impoundment during operation. In another embodiment, controlling can include maintaining a target temperature within the heterogeneous hydrated matrix during operation. As one example, the temperature within the heterogeneous hydrated matrix can be maintained below the boiling point of water or other liquid in the heterogeneous hydrated matrix. In still another embodiment, controlling includes maintaining a target pressure within the permeability control impoundment during operation. It is understood that the present temperature and pressure manipulations can be used individually or in combination.

The operational parameters of the constructed permeability control infrastructure can be adjusted to maintain a sufficient saturated hydraulic conductivity within the heterogeneous hydrated matrix to contain vapors within the permeability control infrastructure. Saturated hydraulic conductivity ($K_{sat}$) is a measure of the ease with which a liquid can move through a saturated porous material. The saturated hydraulic conductivity can be maintained below $10^{-6}$ cm/s and preferably below $10^{-7}$ cm/s. Kozeny-Carman equation can be used to relate saturated hydraulic conductivity to other parameters of the heterogeneous hydrated matrix:

$$K_{sat} = \frac{1}{C_S S_S^2 T^2} \frac{\gamma_w}{\eta} \frac{e^3}{1+e}$$

where $C_S$ is a shape factor, $S_S$ is specific surface area, T is tortuosity of flow channels, $\gamma_w$ is the unit weight of water, η is viscosity, and e is a void ratio. These parameters can be adjusted to control the saturated hydraulic conductivity. For example, the heterogeneous hydrated matrix can be formed of materials having a high shape factor or high surface area, or which provide a highly tortuous path for water to flow through the matrix. In one example, the viscosity can be modified by adding additives to the matrix. As a general rule, increasing fluid viscosity reduces diffusivity along the path, helps to maintain a continuous liquid phase (reduces hydraulic conductivity) and therefore helps to maintain a barrier to gas transport. Depending on specific conditions and operating parameters, diffusivity of vapors through the continuous phase will often be less than about 1 E-5 $cm^2$/sec, and most often less than 1E-6 $cm^2$/sec.

In addition to the operational parameters, the present constructed permeability control infrastructures can be structured to provide a vapor barrier during and after operation. As discussed herein, generally, the presently disclosed heterogeneous hydrated matrix can provide such a barrier. Additionally, structural modifications may be made to further impede vapor migration out of the encapsulated volume. For example, the heterogeneous hydrated matrix can include an additive to the continuous liquid phase that impedes the permeation rate of the vapor. Such additives can include pH buffers, viscosity modifiers, and the like. Further, such materials can include various ratios of earthen materials and/or can further include pH adjustment additives. For example, basic materials such as lye may be added or acidic materials such as acidic soils may be added. Still further, the heterogeneous hydrated matrix can be manufactured with materials that maintain or increase the surface tension of the fluid used during hydration. Generally, hydration includes the use of water and may include other fluids and additives. Such materials and additives can impact the overall surface tension of the hydrated matrix.

The solid materials in the heterogeneous hydrated matrix can have a void space distributed throughout the matrix, the void space being filled by the continuous liquid phase. The overall percent of void space in the matrix and the distribution of that void space can both affect the permeation rate of vapor into the matrix. Generally, the permeation rate can be lower when the void space is distributed more uniformly throughout the hydrated matrix, as opposed to when the void space is concentrated in large pockets. For example, a matrix with a suitable void space distribution can be non-vuggy, meaning that the matrix does not have pockets of void space that are much larger than the solid particles in the matrix. Such pockets of void space, or "vugs," tend to increase the hydraulic conductivity of the matrix and reduce the tortuosity.

The shape and size distribution of the solid particles can also affect the permeation rate. For example, irregularly shaped particles having a broad size distribution can lead to a highly tortuous flow pathway for vapor or liquid moving through the heterogeneous hydrated matrix. Diffusion of vapor molecules through the liquid phase of the matrix can be impeded by increasing the length of the flow pathway through which the molecules diffuse. Increasing the tortuosity of flow pathways in the matrix can thus lower the permeation rate. In some cases, the diffusivity of produced vapors through the hydrated matrix can be lower than the diffusivity of the vapors in pure water.

Additional structural parameters that can impede the permeation rate of the vapor include the thickness of the heterogeneous hydrated matrix and optional additional layers within the infrastructure. For example, the thickness of the hydrated matrix can be increased thereby providing a longer pathway for the vapor to traverse the constructed permeability control infrastructure. Such dimensions of the heterogeneous hydrated matrix can be tailored to the operation and/or carbonaceous materials being processed. For example, for a carbonaceous material requiring high temperature/pressure, the width of the heterogeneous hydrated matrix can be considerably higher than materials requiring a relatively lower temperature/pressure. As a general guideline, the heterogeneous hydrated matrix can have a thickness from about 0.3 to about 2 meters, and often from about 0.6 to about 1.2 meters, although actual thicknesses can largely depend on the size of the structure, designed operational time, composition of the heterogeneous hydrated matrix, and other factors. It is understood that one skilled in the art will be able to modify such parameters based on the operational needs of the particular system using the principles outlined herein. Additionally, the width of the heterogeneous hydrated matrix need not be uniform.

A constructed permeability control infrastructure generally comprises a permeability control impoundment defining a substantially encapsulated volume. The impoundment comprises a heterogeneous hydrated matrix, where the heterogeneous hydrated matrix is penetrable by a vapor having a permeation rate. A comminuted hydrocarbonaceous material can be oriented within the encapsulated volume forming a permeable body of hydrocarbonaceous material. The heterogeneous hydrated matrix impedes the vapor sufficient to contain the vapor within the constructed permeability control infrastructure during operation.

Generally, the present embodiments can be an effective approach to recovering hydrocarbons from organic rich hydrocarbonaceous materials within the constructed permeability control infrastructure. Typically, the hydrocarbonaceous material is substantially stationary during heating, aside from settling and subsidence due to removal of material from the permeable body.

Regarding general elements of the constructed permeability control infrastructure, the constructed infrastructure can define a substantially encapsulated volume where a comminuted hydrocarbonaceous material, including a mined or harvested hydrocarbonaceous material, can be introduced into the control infrastructure to form a permeable body. The control infrastructure can be formed at least partially of earthen material to form a barrier to uncontrolled escape of fluids from the impoundment. The permeable body can be heated sufficient to remove hydrocarbons therefrom. During heating, the comminuted hydrocarbonaceous material is substantially stationary as the constructed infrastructure is a fixed structure. Removed hydrocarbons can be collected for further processing, use in the process, and/or use as recovered. As discussed above, the constructed permeability control infrastructure generally includes a heterogeneous hydrated matrix within the structure to provide a vapor barrier.

Each of these aspects of the present invention is described in further detail below. The constructed permeability control infrastructure can be formed using existing grade as floor support and/or as side wall support for the constructed infrastructure. For example, the control infrastructure can be formed as a free standing structure, i.e. using only existing grade as a floor with side walls and ceiling being man-made. Alternatively, the control infrastructure can be formed within an excavated pit. Regardless, the control infrastructures of the present invention are formed above-grade, including excavated grade.

A constructed permeability control infrastructure can include a permeability control impoundment which defines the substantially encapsulated volume. The permeability control impoundment can also be substantially free of undisturbed geological formations. Specifically, the permeability control aspect of the impoundment can be completely constructed and manmade as a separate isolation mechanism for prevention of uncontrolled migration of material into or out of the encapsulated volume. In one embodiment, the constructed permeability control infrastructure can include a permeable body of comminuted hydro carbonaceous material, a layer of gravel fines, a fluid barrier layer of bentonite amended soil (BAS layer), a heterogeneous hydrated material, and an adjacent native formation. In another embodiment, the control infrastructure at least partially comprises a compacted earthen material. In one aspect, the earthen material can include clay (e.g. bentonite clay or other swelling clays), compacted fill, refractory cement, cement, bentonite amended soil, compacted earth, low grade shale, or combinations thereof. In one aspect, the control infrastructure can comprise bentonite amended soil.

The control infrastructure can often be formed as free-standing berms having underlying earth as structural foundation and support for floors of the infrastructure. In one aspect, the berms can comprise a compacted earthen material. In one embodiment, the permeability control impoundment, or control infrastructure, can be formed along walls of an excavated hydrocarbonaceous material deposit. In one alternative aspect, at least one additional excavated hydrocarbonaceous material deposit can be formed such that a plurality of impoundments can be operated. Further, such a configuration can facilitate a reduction in transportation distance of the mined material. Specifically, the mined hydrocarbonaceous material for any particular encapsulated volume can be mined from an adjacent excavated hydrocarbonaceous material deposit. In this manner, a grid of constructed structures can be built such that mined material can be immediately and directly filled into an adjacent impoundment.

The impoundment can be formed of a suitable material, including the use of a heterogeneous hydrated matrix, which provides isolation of material transfer across walls of the impoundment. In this manner, integrity of the walls is retained during operation of the control infrastructure sufficient to substantially prevent uncontrolled migration of fluids and vapors outside of the control infrastructure. Non-limiting examples of suitable material for use in forming the impoundment of the constructed permeability control infrastructure can include clay, bentonite clay (e.g. clay comprising at least a portion of bentonite which includes montmorillonite), compacted fill, refractory cement, cement, synthetic geogrids, fiberglass, rebar, hydrocarbon additives, filled geotextile bags, polymeric resins, PVC liners, or combinations thereof. For large scale operations forming the impoundment at least partially of earthen material can provide an effective barrier. Engineered cementitious composites (ECC) materials, fiber reinforced composites, and the like can be particularly strong and can be readily engineered to meet permeability and temperature tolerance requirements of a given installation.

As a general guideline, for the impoundment, materials having low permeability and high mechanical integrity at operating temperatures of the infrastructure can be used. For example, matrix materials having a melting point above the maximum operating temperature of the infrastructure can be useful to maintain containment during and after heating and recovery. Alternatively, such matrix materials can include either solid or fluid where a fluid has a continuous phase throughout. However, lower temperature materials can also be used if a buffer zone is maintained as an insulating layer between the walls and heated portions of the permeable body. Such buffer zones can typically range from 15 cm to 6 meters depending on the particular material used for the impoundment and the composition of the permeable body.

Impoundment walls may be substantially continuous such that the impoundment defines the encapsulated volume sufficiently to prevent substantial movement of fluids into or out of the impoundment other than defined inlets and outlets, e.g. via conduits or the like as discussed herein. In this manner, the impoundments can readily meet government fluid migration regulations. Alternatively, or in combination with a manufactured barrier, portions of the impoundment walls can be undisturbed geological formation and/or compacted earth. In such cases, the constructed permeability control infrastructure is a combination of permeable and impermeable walls as described in more detail below.

In one detailed aspect, a portion of hydrocarbonaceous material, either pre- or post-processed, can be used as a cement fortification and/or cement base which are then poured in place to form portions or the entirety of walls of the control infrastructure. These materials can be formed in place or can be preformed and then assembled on site to form an integral impoundment structure. For example, the impoundment can be constructed by cast forming in place as a monolithic body, extrusion, stacking of preformed or precast pieces, concrete panels joined by a grout (cement, ECC or other suitable material), inflated form, or the like. The forms can be built up against a formation or can be stand alone structures. Forms can be constructed of a suitable material such as, but not limited to, steel, wood, fiberglass, polymer, or the like. Optional binders can be added to enhance compaction of the permeability control walls. The control infrastructure can optionally comprise, or consist essentially of, sealant, grout, rebar, synthetic clay, bentonite clay, swellable clay lining, refractory cement, high temperature geomembranes, or combinations thereof.

In one embodiment, the construction of impoundment walls and floors can include multiple compacted layers of indigenous or manipulated low grade shale with any combination of sand, cement, fiber, plant fiber, nanocarbons, crushed glass, reinforcement steel, engineered carbon reinforcement grid, calcium minerals, and the like. In addition to such composite walls and the heterogeneous hydrated matrix, designs which inhibit long term fluid and gas migration through additional impermeability engineering can be employed including, but not limited to, liners, geo-membranes, compacted soils, imported sand, gravel or rock and gravity drainage contours to move fluids and gases away from impervious layers to egress exits. Impoundment floor and wall construction, can, but need not comprise, a stepped up or stepped down slope or bench as the case of mining course may dictate following an optimal ore grade mining. In any such stepped up or down applications, floor leveling and containment wall construction can typically drain or slope to one side or to a specific central gathering area(s) for removal of fluids by gravity drainage assistance.

Optionally, capsule wall and floor construction can include insulation which prevents heat transfer to the heterogeneous hydrated matrix sufficient to maintain integrity of the hydrated matrix. Insulation can comprise manufactured materials, cement or various other materials which are less thermally conductive than surrounding masses, i.e. permeable body, formation, adjacent infrastructures, etc. Thermally insulating barriers can also be formed within the permeable body, along impoundment walls, ceilings and/or floors. The impoundment can be formed as a single use system such that insulations, pipes, and/or other components can have a relatively low useful life, e.g. less than 1-2 years. In his manner, conduits, barrier, and insulation materials can be left in place along with spent feedstock materials upon completion of recovery and shutdown of the system. This can reduce equipment costs as well as reduce long-term environmental impact.

The structures and methods presented herein can be applied at almost any scale. Larger encapsulated volumes and increased numbers of impoundments can readily produce hydrocarbon products and performance comparable to or exceeding smaller constructed infrastructures. As an illustration, single impoundments can range in size from tens of meters across to tens of acres in top plan surface area. Similarly, impoundment depths can vary from several meters up to about 100 meters, with about 50 meters providing one exemplary depth. Optimal impoundment sizes may vary depending on the hydro carbonaceous material and operating parameters, however it is expected that suitable areas per impoundment cell can range from about one-half to fifteen acres in top plan surface area. An array of impoundment cells can be arranged adjacent one another to form a plurality of individually controllable units which can be operated at least partially independent of adjacent cells. Recognition and adjustment of operating parameters can also take into account heat transfer from adjacent cells.

The methods and infrastructures can be used for recovery of hydrocarbons from a variety of hydrocarbonaceous materials. One particular advantage is a wide degree of latitude in controlling particle size, conditions, and composition of the permeable body introduced into the encapsulated volume. Non-limiting examples of mined hydrocarbonaceous material which can be treated comprise oil shale, tar sands, coal, lignite, bitumen, peat, or combinations thereof. Additionally, high organic content material which can be treated includes peat, coal, biomass, tar sands, or combinations thereof. The permeable body can include mixtures of these materials such that grade, oil content, hydrogen content, permeability and the like can be adjusted to achieve a desired result. Further, multiple hydrocarbonaceous materials can be placed in segregated layers or in a mixed fashion such as combining coal, oil shale, tar sands, biomass, and/or peat.

As discussed herein, generally the comminuted hydrocarbonaceous material has a porosity enabling the extraction of products. In one embodiment, the permeable body can have a porosity (i.e. void space) from about 10% to about 80% of the total volume of the permeable body before and during heating. In one aspect, the permeable body can maintain a porosity from about 40% to about 70% of the total volume of the permeable body before and during heating.

In one embodiment, hydrocarbon containing material can be classified into various inner capsules or cells within a primary constructed infrastructure for optimization reasons. For instance, layers and depths of mined oil shale formations may be richer in certain depth pay zones as mining progresses. Once, blasted, mined, shoveled and hauled inside of a capsule for placement, richer oil bearing ores can be classified or mixed by richness for optimal yields, faster recovery, or for optimal averaging within each impoundment. The ability to selectively control the characteristics and composition of the permeable body adds a significant amount of freedom in optimizing oil yields and quality. Furthermore, the liberated gaseous and liquid products can act as an in situ produced solvent which supplements kerogen removal and/or additional hydrocarbon removal from the hydrocarbonaceous material.

Optionally, the permeable body can further comprise an additive or biomass. Additives can include compositions which act to increase the quality of removed hydrocarbons, e.g. increased API, decreased viscosity, improved flow properties, reduced wetting of residual shale, reduction of sulfur, hydrogenation agents, etc. Non-limiting examples of suitable additives can include bitumen, kerogen, propane, natural gas, natural gas condensate, crude oil, refining bottoms, asphaltenes, common solvents, other diluents, and combinations of these materials. In one specific embodiment, the additive can include a flow improvement agent and/or a hydrogen donor agent. Further, manmade materials can also be used as additives such as, but not limited to, tires, polymeric refuse, or other hydrocarbon-containing materials.

Particle sizes throughout the permeable body can vary considerably, depending on the material type, desired heating rates, and other factors. As a general guideline, the permeable body can include comminuted hydrocarbonaceous particles from about 0.3 cm to about 2 meters on average, and in some cases less than 30 cm and in other cases less than about 16 cm on average. However, as a practical matter, sizes from about 5 cm to about 60 cm on average, or in one aspect about 16 cm to about 60 cm on average, can provide good results with about 30 cm average diameter being useful for oil shale especially. Void space from about 15% to about 40% and in some cases about 30% usually provides a good balance of permeability and effective use of available volumes.

The comminuted hydrocarbonaceous material can be filled into the control infrastructure to form the permeable body in a suitable manner. Typically the comminuted hydrocarbonaceous material can be conveyed into the control infrastructure by dumping, conveyors or other suitable approaches. As mentioned previously, the permeable body can have a carefully tailored high void volume. Thus, the permeable body can be formed by low compaction conveying of the hydrocarbonaceous material into the infrastructure. In this way, the hydrocarbonaceous material can retain a significant void volume between particles without substantial further crushing or compaction despite some small degree of compaction which often results from lithostatic pressure as the permeable body is formed.

Once a desired permeable body has been formed within the control infrastructure, heat can be introduced sufficient to begin removal of hydrocarbons, e.g. via pyrolysis. A suitable heat source can be thermally associated with the permeable body. Optimal operating temperatures within the permeable body can vary depending on the composition and desired products. However, as a general guideline, operating temperatures for oil shale can range from about 93° C. to about 400° C. Temperature variations throughout the encapsulated volume can vary and may reach as high as 480° C. or more in some areas. In one embodiment, the operating temperature can be a relatively lower temperature to facilitate production of liquid product such as from about 93° C. to about 340° C. This heating step can be a roasting operation which results in beneficiation of the crushed ore of the permeable body. Generally, products can include both liquid and gaseous products.

Heat can be transferred into and throughout the permeable body primarily via convection. Heated gases can be injected into the control infrastructure such that the heated gases pass throughout the permeable body. Heated gases can be produced by combustion of natural gas, hydrocarbon product, or other suitable source. The heated gases can be imported from external sources or recovered from the process of the present invention. The heated gases can be directed through the permeable body via embedded heating conduits. In this manner, the heating gases can be provided in a closed system to prevent mixing the heated gases with the permeable body. Alternatively, heated gases can be circulated via convection directly within the permeable body.

The plurality of conduits can be readily oriented in a variety of configurations, whether substantially horizontal, vertical, slanted, branched, or the like. Configurations can be tailored to provide desirable convective heat flow patterns throughout the permeable body and to avoid substantial variations in temperatures (i.e. cold and/or hot spots). It is generally desirable to provide as uniform a heat distribution as possible. At least a portion of the conduits can be oriented along predetermined pathways prior to embedding the conduits within the permeable body. The predetermined pathways can be designed to improve heat transfer, gas-liquid-solid contacting, maximize fluid delivery or removal from specific regions within the encapsulated volume, or the like. Further, at least a portion the conduits can be dedicated to heating of the permeable body. These heating conduits can optionally be selectively perforated to allow heated gases or other fluids to convectively heat and mix throughout the permeable body. Alternatively, the heating conduits can form a closed loop such that heating gases or fluids are segregated from the permeable body. Thus, a "closed loop" does not necessarily require recirculation, rather isolation of heating fluid from the permeable body. In this manner, heating can be accomplished primarily or substantially only through thermal conduction across the conduit walls from the heating fluids into the permeable body. Heat transfer within the permeable body then proceeds primarily via convective heating. Such a closed loop system provides control of the atmosphere in the permeable body which is substantially free of oxygen.

During the heating or roasting of the permeable body, localized areas of heat which exceed parent rock decomposition temperatures, often above about 480° C., can reduce yields and form carbon dioxide and undesirable contaminating compounds which can lead to leachates containing heavy metals, soluble organics and the like. The heating conduits can allow for substantial elimination of such localized hot spots while maintaining a vast majority of the permeable body within a desired temperature range. The degree of uniformity in temperature can be a balance of cost (e.g. for additional heating conduits) versus yields.

Although products can vary considerably depending on the starting materials, high quality liquid and gaseous products are possible. For example, crushed oil shale material can produce a liquid product having an API gravity from about 30 to about 45, with about 33 to about 38 being currently typical, directly from the oil shale without additional treatment. Interestingly, it has been found that pressure appears to be a much less influential factor on the quality of recovered hydrocarbons than temperature and heating times. Although heating times can vary considerably, depending on void space, permeable body composition, quality, etc., as a general guideline times can range from a few days (i.e. 3-4 days) up to about one year. In one specific example, heating times can range from about 2 weeks to about 4 months.

Further, walls of the constructed infrastructure can be configured to minimize heat loss. In one aspect, the walls can be constructed having a substantially uniform thickness which is optimized to provide sufficient mechanical strength while also minimizing the volume of wall material through which the conduits pass. Specifically, excessively thick walls can reduce the amount of heat which is transferred into the permeable body by absorbing the same through conduction. Conversely, the walls can also act as a thermal barrier to somewhat insulate the permeable body and retain heat therein during operation.

Additionally, in one embodiment, the present constructed permeability control infrastructure can be heated and/or cooled under specific temperature profiles to substantially eliminate or minimize the formation of unwanted accumulated hydrocarbon material. Generally, the present infrastructures can be operated to heat at least a portion of the permeable body to a bulk temperature above a production temperature sufficient to remove hydrocarbons therefrom, where conditions in non-production zones are maintained below the production temperature. In one aspect, the infrastructure can have a production temperature ranging from at least 93° C. to 480° C. In another aspect, the infrastructure can have a bulk temperature ranging from over 93° C. to 480° C. In one detailed aspect, the bulk temperature can be between 200° C. and 480° C.

In order to decrease or eliminate the amount of liquids retained in the non-production zone, several conditions can be maintained. As discussed above, during operation of the system, temperatures below the liquid collection system can be maintained below a production temperature for the corresponding hydrocarbonaceous materials. As a result, materials in the non-production zone do not produce hydrocarbons. Further, as the fluid barrier properties of the impoundment barrier layer can be maintained via a heterogeneous hydrated matrix. For example, when using bentonite amended soil (BAS) the fluid barrier properties are maintained as long as the BAS layer is hydrated. During operation, hydration can be maintained by keeping temperatures throughout the BAS layer below about 100° C., or more typically below about 93° C. in order to avoid hot spots and localized dehydration of the BAS.

Figure 2:
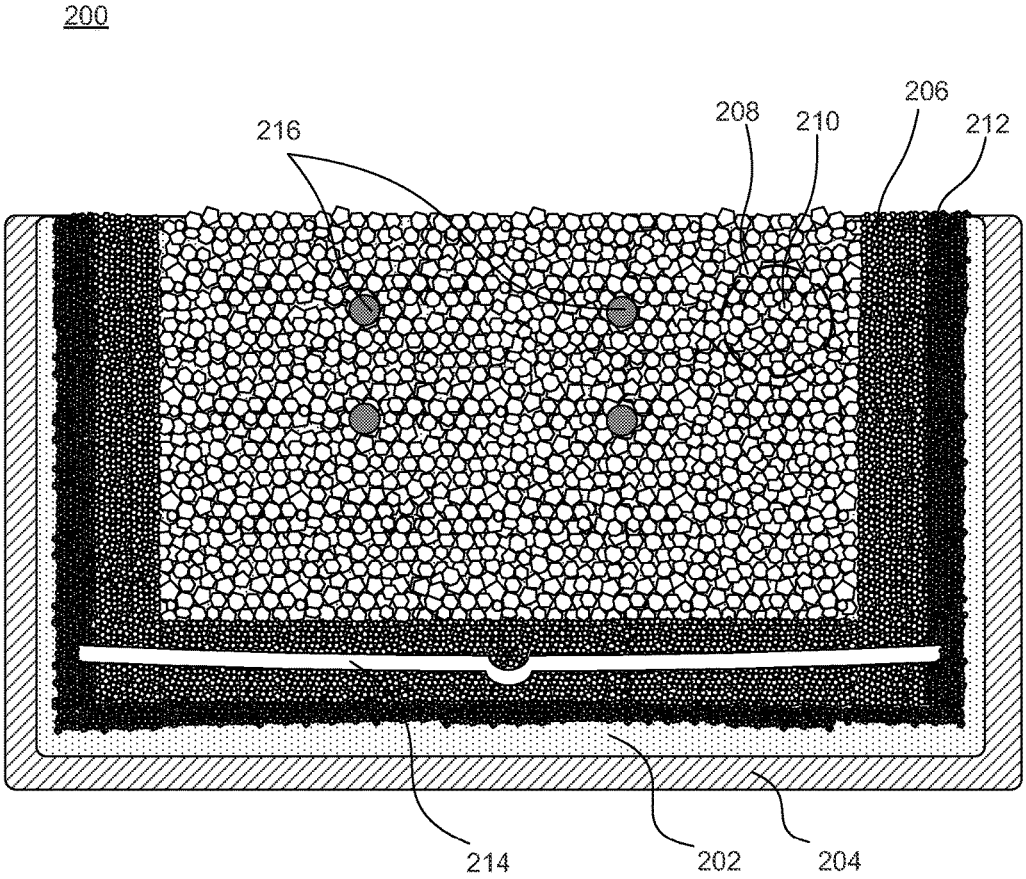
FIG. 2 is a side cutaway view of a permeability control impoundment in accordance with one embodiment of the present invention.

With the above description in mind, FIG. 2 depicts a cross-sectional perspective of a constructed permeability control infrastructure 200 including a heterogeneous hydrated matrix 212 with an optional barrier layer 202 formed adjacent native formation 204 or other structure (e.g. an adjacent impoundment). A layer of gravel fines 206 is also provided adjacent the heterogeneous hydrated matrix layer as a primary insulating layer and/or condensation layer. The gravel fines layer has a substantially reduced void space over the permeable body 208 such that it is not designed as a hydrocarbon production zone. Rather, the gravel fines layer can act as an insulating layer to allow cooling of fluids within the permeable body so as to reduce temperature prior to fluid contact with the heterogeneous hydrated matrix. This can reduce rates of dehydration and permeation through the hydrated matrix. Although specific thicknesses can vary, the gravel fines layer can range from about 15 cm to about 6 meters.

In some cases, side walls can be free standing berms in which case outer layers of the infrastructure are exposed. Encapsulated within the layer of gravel fines is the permeable body 208 (portion of which is circled) of comminuted oil shale 210 forming a production volume having average particle sizes that are suitable for production of hydrocarbons. Typically, the gravel fines layer can comprise crushed oil shale having an average particle size substantially smaller than the average particle size within the primary production volume of the permeable body. Although the average particle size of the fines layer can vary, typically the average particle size can range from about 0.25 to about 10 cm. A heterogeneous hydrated matrix 212 with a continuous liquid phase can be placed within a wall of the control infrastructure to act as a primary vapor barrier. Although the heterogeneous hydrated matrix is shown between the gravel fines layer 206 and the optional barrier layer 202, such placement is not limiting.

An optional primary liquid collection system 214 can be oriented within a lower portion of the crushed oil shale within the layer of gravel fines 206. Although the primary liquid collection system is shown in the gravel layer midway between the permeable body 208 and the optional barrier layer 202, such location is for illustration purposes and is not intended to be limiting. As such, the primary liquid collection system can located approximately midway, in the upper portion of the gravel layer, or in the lower portion of the gravel layer. The liquid collection system can be configured to collect fluids across the entire cross-section of the permeable body. The collections system can be a single continuous layer, or may be formed of multiple discrete collection trays. In one example, the liquid collection system can be a drain pan which extends through the layer of gravel fines to the surrounding heterogeneous hydrated matrix layer 212. Although removal of liquids can be accomplished via pumping, typically gravity drainage can provide sufficient removal flow rates. In one aspect, the drain pan can cover the entire floor of the infrastructure.

A plurality of heating conduits 216 can be embedded within the permeable body so as to heat the hydrocarbonaceous material sufficient to initiate pyrolysis and production of hydrocarbons. The optional barrier layer is typically not needed, however such a layer can be provided as a secondary barrier such as a membrane, liner or other suitable barrier.

During operation, the permeable body of hydrocarbonaceous material is heated to a predetermined production temperature corresponding to liberation and/or production of hydrocarbons from the corresponding hydrocarbonaceous material. However, the entire system exhibits temperature gradients which vary throughout. For example, for oil shale processing, the permeable body may have a peak bulk temperature around 400° C. with a decreasing temperature gradient approaching the surrounding formation which is often around 16° C. In order to decrease or eliminate the amount of liquids retained in the non-production zone, several conditions can be created and maintained. During operation of the system, temperatures below the liquid collection system can be maintained below a production temperature for the corresponding hydrocarbonaceous materials. As a result, materials in the non-production zone do not produce hydrocarbons.

Further, the fluid barrier properties of the heterogeneous hydrated matrix can be maintained as long as hydration is maintained. Upon dehydration, the hydrating material within the matrix reverts to a particulate state, with loss of the continuous liquid phase, allowing fluids to pass. During operation, hydration can be maintained by keeping temperatures throughout the heterogeneous hydrated matrix below 93° C. Additionally, the infrastructures can optionally further include hydration mechanisms to supply water to the heterogeneous hydrated matrix. Such hydration mechanisms can be located along the matrix such that adequate hydration of the hydrating material is achieved so as to preserve substantial fluid impermeability during operation.

Temperature at the primary liquid collection system and the hydrated matrix can be controlled by adjusting heating rates from the bulk heating conduits, varying void space within the permeable body, varying thickness of the gravel fines layer, and adjusting the fluid removal rates via the drain system. Optional supplemental cooling loops can be provided to remove heat from near the primary liquid collection system and/or the hydrated matrix.

Hydrocarbon products recovered from the permeable body can be further processed (e.g. refined) or used as produced. Condensable gaseous products can be condensed by cooling and collection, while non-condensable gases can be collected, burned as fuel, reinjected, or otherwise utilized or disposed of Optionally, mobile equipment can be used to collect gases. These units can be readily oriented proximate to the control infrastructure and the gaseous product directed thereto via suitable conduits from an upper region of the control infrastructure.

In yet another alternative embodiment, heat within the permeable body can be recovered subsequent to primary recovery of hydrocarbon materials therefrom. For example, a large amount of heat is retained in the permeable body. In one optional embodiment, the permeable body can be flooded with a heat transfer fluid such as water to form a heated fluid, e.g. heated water and/or steam.

Various stages of gas production can be manipulated through processes which raise or lower operating temperatures within the encapsulated volume and adjust other inputs into the impoundment to produce gases which can include but are not limited to, hydrogen, hydrogen sulfide, hydrocarbons, ammonia, water, nitrogen or various combinations thereof. Hydrocarbon product recovered from the constructed infrastructures can most often be further processed, e.g. by upgrading, refining, etc.

Figure 3A:
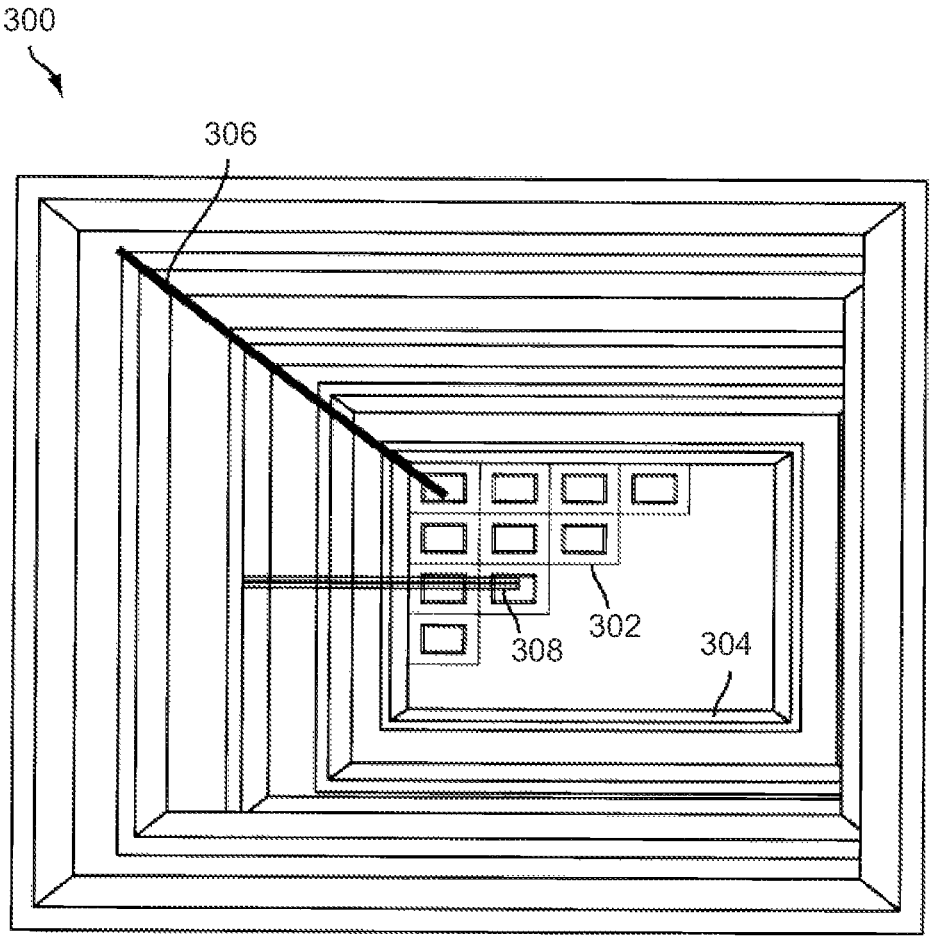
FIGS. 3A and 3B are a top and plan view, respectively, of a plurality of permeability control impoundments in accordance with one embodiment of the present invention.
Figure 3B:
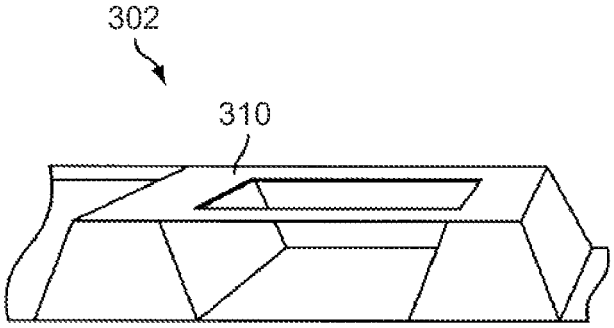

FIG. 3A shows a collection of impoundments including an uncovered or uncapped capsule impoundment 300, containing sectioned capsule impoundments 302 inside of a mining quarry 304 with various elevations of bench mining. Optional shutes and conveyors 306 and 308 can be used to deposit materials into each impoundment 302. FIG. 3B illustrates a single impoundment 302 having an upper surface 310 without associated conduits and other aspects merely for clarity. This impoundment can be similar to that illustrated in FIG. 2 or can utilize another configuration.

Figure 4:
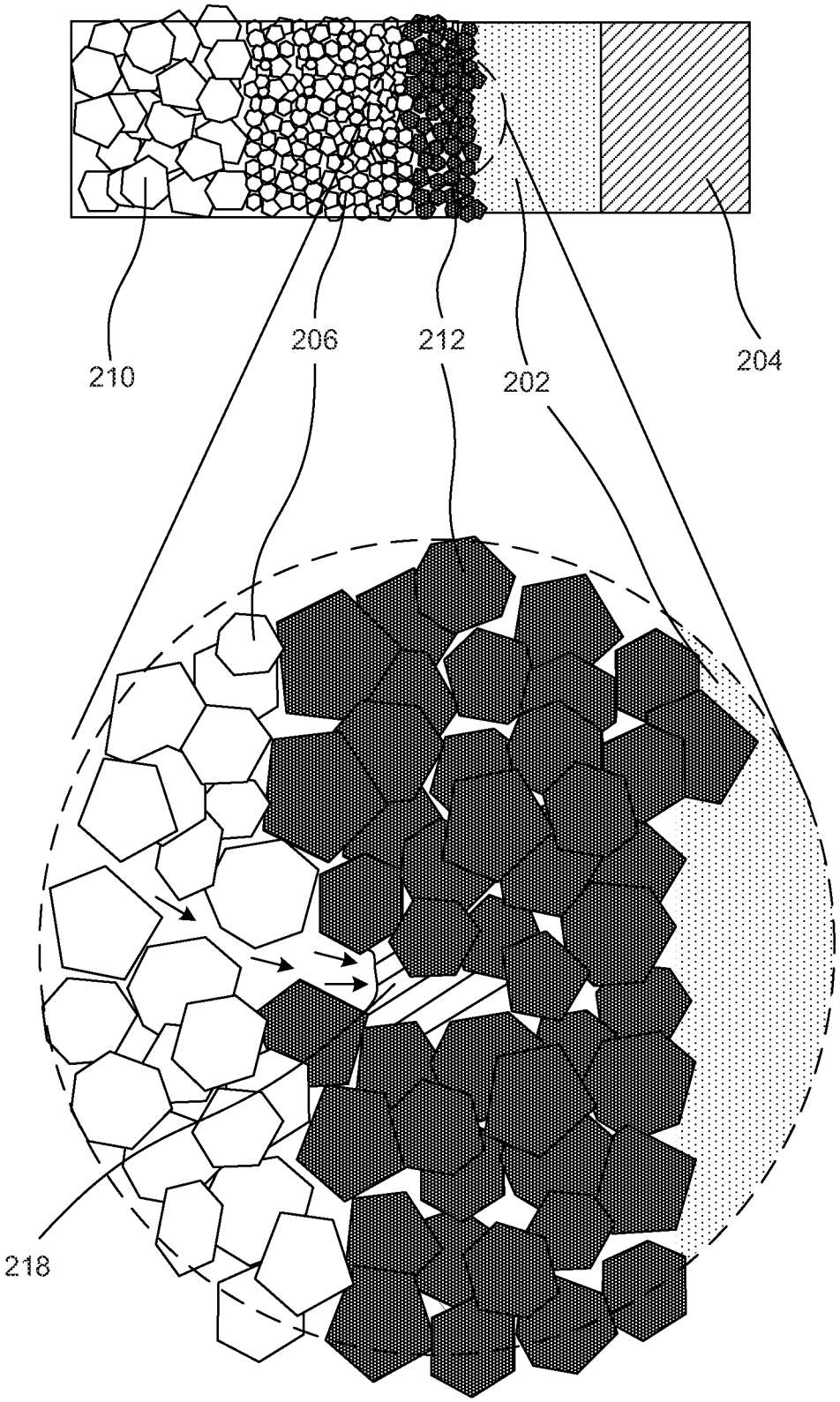
FIG. 4 is a cross section of a portion of a constructed permeability control infrastructure, with an expanding view of vapor penetration, in accordance with one embodiment of the present invention.

FIG. 4 shows a cross sectional area of a portion of the constructed permeability control infrastructure including comminuted oil shale 210, a layer of gravel fines 206, a heterogeneous hydrated matrix 212, an optional barrier layer 202, and native formation 204 or other structure (e.g. an adjacent impoundment), with an expanded view showing a vapor (indicated by the arrows) acting on the fluid 218 of the hydrated layer. The vapors produced during operation of the constructed permeability control infrastructure may penetrate through the infrastructure (e.g. the gravel fines layer) but can be impeded using the hydrated layer. The hydrated layer need not be completely impermeable to vapor but can act as impedance to the penetration and permeation rate of the vapor sufficient to maintain the vapor within the constructed permeability control infrastructure during operation and/or after operation. More specifically, the heterogeneous hydrated matrix includes a solid phase of packed particulate material with a liquid phase filling voids between solid phase. The liquid phase includes a substantially continuous network of liquid throughout the heterogeneous hydrated matrix. In this manner, migration of vapor and gases from the production layers (e.g. oil shale or other hydro carbonaceous material) is limited by diffusion of such vapors and gases through the liquid phase. In contrast, open gas pathways within a barrier allow rates of permeation to be governed by pressure differentials. In the heterogeneous hydrated matrix, rates of diffusion are controlled by partial pressure and concentration gradients rather than merely pressure differentials. As discussed herein, the resistance to vapor penetration can be dependent upon a number of factors including pH of the fluid, surface tension of the fluid, the temperature of the fluid, the pressure of the fluid, the porosity of the matrix, etc. These factors can be modified by the materials used in making the hydrated layer as well as the surrounding structures. For example, as fluids penetrate into the hydrated matrix layer, the fluid can contact hydrating materials and non-hydrating materials. Each component of the hydrated matrix can make different contributions to permeation inhibiting properties of the matrix layer. The permeation rate can be further controlled by operational and structural parameters as discussed herein.

EXAMPLE

A sample of shale was selected and sieved to less than ⅜ inch. To this sample 16 wt % of bentonite clay was added.

To this dry mixture 17.7 wt % water was added. The specimen was thoroughly mixed and compacted in a cylindrical form of 3" in diameter and 6" long to a density of 108.6 lb/ft$^3$. The compacted specimen was inserted into a specialized gas permeameter and isolated with a synthetic membrane. The specimen was subjected to an isotropic confining stress of 20 psig with surrounding water and the specimen was allowed to further consolidate for 6 days.

An amount of 0.5 psig (13 psia at laboratory conditions) He pressure was applied to the bottom surface, and 0 psig (12.5 psia) of $N_2$ pressure was applied to the top surface. Fresh He was swept across the bottom surface at 0.5 psig. The outlet to the top surface was blocked-in by shutting outlet valves (static volume of the top surface space was 12.53 cm$^3$). Over a period of 3 days the pressure at the top surface rose to 1.306 psig (13.806 psia) as He diffused to the top, closed space faster than the $N_2$ diffused to the bottom, open space. This was direct evidence that the transport of gases across the length of the specimen was controlled by molecular diffusion because the absolute pressure in the closed space rose to a level greater than the applied absolute pressure at the inlet. The outlet was next opened and the net flow of He from the inlet to the outlet was measured by water displacement over a period of 25 days at 0.2506 cm$^3$/day. This corresponds to a flux of 2.4239E-12 g-moles/sec-cm$^2$ and a diffusivity of 1.0480E-6 cm$^2$/sec. The literature value for diffusivity of $H_2$ (a good surrogate for He) in pure water is 4.50E-5 cm$^2$/sec. Hence the permeation rate limitations imposed by the matrix and the tortuosity of the diffusion path slow the permeation rate to 2.33E-2 that of ideal permeation in water which is evidence of the practice of the invention. The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A method of minimizing vapor transmission from a constructed permeability control infrastructure, comprising:

forming a heterogeneous hydrated matrix comprised of a swelling clay in an amount ranging from 4 to 100 vol % within a wall of the constructed permeability control infrastructure, the constructed permeability control infrastructure comprising a permeability control impoundment defining a substantially encapsulated volume, the permeability control impoundment containing a comminuted hydrocarbonaceous material from which a hydrocarbon vapor is to be produced, the heterogeneous hydrated matrix having a particulate solid phase and a continuous liquid phase which is penetrable by the hydrocarbon vapor having a permeation rate;

operating the constructed permeability control infrastructure by heating the comminuted hydrocarbonaceous material sufficient to produce the hydrocarbon vapor therefrom; and controlling the permeation rate by manipulating an operational parameter of the constructed permeability control infrastructure to maintain the continuous liquid phase during operating;

wherein the vapor is impeded during operating sufficient to contain the vapor within the constructed permeability control infrastructure.

2. The method of claim 1, further comprising forming the heterogeneous hydrated matrix by hydrating an earthen material, the earthen material selected from the group consisting of swellable clay, compacted fill, refractory cement, cement, clay amended soil, compacted earth, low grade shale, or combinations thereof.

3. The method of claim 2, further comprising comminuting the earthen material to a size that, when hydrated, impedes the permeation rate.

4. The method of claim 1, wherein controlling includes maintaining hydration of the heterogeneous hydrated matrix.

5. The method of claim 1, wherein the heterogeneous hydrated matrix includes an additive that impedes the permeation rate.

6. The method of claim 1, wherein controlling includes maintaining at least one of a target pH within the heterogeneous hydrated matrix, a target surface tension of liquid within the heterogeneous hydrated matrix, a target temperature within the heterogeneous hydrated matrix, a target temperature within the permeability control impoundment, and a target pressure within the permeability control impoundment during operation.

7. The method of claim 1, wherein controlling includes maintaining a saturated hydraulic conductivity of the heterogeneous hydrated matrix.

8. The method of claim 7, wherein the saturated hydraulic conductivity is less than $10^{-6}$ cm/s.

9. The method of claim 1, wherein the control infrastructure at least partially comprises a compacted earthen material selected from the group consisting of clay, swellable clay, compacted fill, refractory cement, cement, clay amended soil, compacted earth, low grade shale, and combinations thereof.

10. The method of claim 1, wherein the constructed permeability control infrastructure comprises swelling clay.

11. The method of claim 1, wherein the infrastructure has a floor which is structurally supported by underlying earth.

12. The method of claim 1, wherein the control infrastructure is free-standing having berms as sidewalls.

13. The method of claim 1, wherein the comminuted hydrocarbonaceous material comprises oil shale, tar sands, coal, lignite, bitumen, peat, biomass, or combinations thereof.

14. The method of claim 1, wherein the control infrastructure is substantially free of undisturbed geological formations.

15. The method of claim 1, wherein the permeable body further comprises a plurality of heating conduits embedded within the comminuted hydrocarbonaceous material, said plurality of heating conduits adapted to heat the comminuted hydrocarbonaceous material.

16. The method of claim 1, wherein the heterogeneous hydrated matrix contains from about 5% to about 20% by volume of swellable clay.

17. The method of claim 1, wherein the heterogeneous hydrated matrix includes a mixture of hydrating and non-hydrating material, wherein the hydrating material has a smaller size distribution than the non-hydrating material.

18. The method of claim 1, wherein a temperature of the heterogeneous hydrated matrix is maintained below about 93° C. during operation.

* * * * *